United States Patent [19]

Sweeney et al.

[11] 4,244,704

[45] Jan. 13, 1981

[54] GASOLINE COMPOSITION

[75] Inventors: William M. Sweeney; Francis S. Bove, both of Wappingers Falls, N.Y.

[73] Assignee: Texaco Inc., White Plains, N.Y.

[21] Appl. No.: 109,703

[22] Filed: Jan. 4, 1980

[51] Int. Cl.[3] ..... C10L 1/18

[52] U.S. Cl. ..... 44/78

[58] Field of Search ..... 44/78, 56; 568/630

[56] References Cited

U.S. PATENT DOCUMENTS

| | | | |
|---|---|---|---|
| 2,952,612 | 9/1960 | Trainer | 44/56 |
| 3,019,094 | 1/1962 | Boudreaux et al. | 44/56 |
| 3,168,385 | 2/1965 | Giammaria et al. | 44/56 |
| 3,224,848 | 12/1965 | Henderson | 44/56 |
| 3,717,611 | 2/1973 | Baumer et al. | 44/78 |
| 4,182,913 | 1/1980 | Takezono et al. | 44/56 |

OTHER PUBLICATIONS

"Preparation of tert—Butyl Ethers", Stevens, 20 J. Org. Chem. 1232–1236, (1955).

"Hydroxylation of Toluene and Xylenes with t-Butyl Hydroperoxide-Aluminium Chloride", Hashimoto et al., Bull. Chem. Society, Japan, 43, 293, (1970).

*Primary Examiner*—Patrick Garvin
*Assistant Examiner*—Y. Harris Smith
*Attorney, Agent, or Firm*—Carl G. Ries; Robert A. Kulason; Carl G. Seutter

[57] ABSTRACT

Substantial increase in octane number of a gasoline is attained by addition of eq. 2 vol. % phenyl t-butyl ether.

6 Claims, No Drawings

GASOLINE COMPOSITION

FIELD OF THE INVENTION

This invention relates to the preparation of gasoline of improved octane number.

BACKGROUND OF THE INVENTION

As is known to those skilled in-the-art-, the octane number of a gasoline may be increased by the addition thereto of various aliphatic ethers. Typical of these ethers is methyl t-butyl ether as disclosed in U.S. Pat. No. 2,046,243 to Buc inter alia. The increasing cost of gasolines has resulted in a continuing search for gasoline compositions of increased octane number.

It is an object of this invention to provide a method of treating a gasoline to improve its octane number. It is another object of this invention to provide a gasoline composition of improved octane number. Other objects will be apparent to those skilled-in-the-art.

SUMMARY OF THE INVENTION

In accordance with certain of its aspects, this invention is directed to a gasoline composition characterized by improved octane number which comprises a major portion of gasoline and a minor, octane-improving, portion of phenyl t-butyl ether.

DESCRIPTION OF THE INVENTION

The gasolines which may be treated by the process of this invention to raise their octane number may be straight run gasolines, but more preferably they will be blended gasolines as available in commerce typically containing components derived from catalytic cracking, reforming, isomerization, etc. Although the octane number of any gasoline may be improved by the technique of this invention, it is preferred to treat charge gasolines of nominal octane number 88–95, eg. 91.

Illustrative of a typical gasoline may be that of the Table:

TABLE

| | |
|---|---|
| ibp | 85° F. |
| ep | 410° F. |
| API | 60° |
| MON | 82.2 |
| RON | 92.4 |
| Aromatics vol % | 28 |
| Paraffins vol % | 60 |
| Olefins | 12 |

The phenyl t-butyl ether which may be employed as an octane appreciator in practice of the process of this invention may, if not readily available, be prepared as by (i) reaction of Grignard reagent phenyl magnesium bromide, in ethyl ether, with t-butyl perbenzoate, (ii) by Williamson synthesis reaction of sodium phenate and t-butyl chloride, etc. Phenyl t-butyl ether is a liquid.

Practice of the process of this invention includes adding to a major portion of gasoline, a minor, octane-improving portion of phenyl t-butyl ether. The ether may be added in amount of typically 1%–10%, say 2%–5%, by volume of the gasoline. It is an unexpected feature that use of low concentrations (such as about 2%) unexpectedly give a greater blending value.

It is a feature of this invention that the novel gasoline compositions may be found to possess increased MON and RON. It is found to be possible, by use of eg. 10 volume percent of phenyl t-butyl ether, to increase the research octane number (clear) by eg. 3.5 units while control ether compositions fall in the 0.2–2.9 range. It is similarly possible to increase the motor octane number by eg 2.8 units while control ether compositions fall in the range of 1.0–2.0.

These improvements of (3.5/2.9) 121% in RON and (2.8/2.0) 140% in MON are substantial and unexpected.

The Blending Value of phenyl t-butyl ether is calculated by adding to the RON of the gasoline which is to be treated, the change in RON divided by the volume % of additive added.

$$BV = [\text{BASE RON}] + \left[\frac{\Delta\ RON}{\text{vol.\% added}}\right]$$

Thus, if addition of 10 vol.% of phenyl t-butyl ether increases by 3.5 units (from 92.4 up to 95.9) the RON of a base gasoline, the BV is $$BV = 92.4 + 3.5/0.10 = 127.4$$

Comparable blending values for MON may be calculated.

The Blending Value is a measure of effectivity of an additive.

It is unexpectedly found that the Blending Value (both MON and RON) of phenyl t-butyl ether is unexpectedly higher when used in concentration of 2% than when used at higher concentrations.

Practice of this invention will be apparent to those skilled-in-the-art from the following description.

DESCRIPTION OF PREFERRED EMBODIMENTS

EXAMPLE I

In this example, phenyl t-butyl ether is prepared. Grignard reagent, phenyl magnesium bromide, is formed by mixing 100 g magnesium turnings with 607.7 g bromobenzene and 6170 g anhydrus ethyl ether. After formation of the Grignard reagent, t-butyl per benzoate (449 g) in ether is added at 15° C.–25° C. under nitrogen with stirring. Reaction product is shaken with cold, dilute hydrochloric acid, then washed with dilue aqueous sodium hydroxide, and then washed with water. It is then dried and distilled to yield 269.2 G of product phenyl t-butyl ether which is analyzed to give 79.1% C (calc 80.0%) and 9.2% H (calc 9.3%).

EXAMPLES II–VII

In this series of examples, the so prepared phenyl t-butyl ether is tested for octane appreciation in a lead-free gasoline. Other octane appreciators were also tested. In each case the ether appreciator was added in amount of 10 vol.% and the increase in research octane number (RON) and motor octane number (MON) was measured. The charge gasoline was a nominal 91 octane, lead-free gasoline.

TABLE

| Example | Additive | ΔRON | ΔMON |
|---|---|---|---|
| II | phenyl t-butyl ether | 3.5 | 2.8 |
| III–IV | methyl and ethyl t-butyl ether | 2.9 | 1.8 |
| V | methyl t-amyl ether | 2.6 | 1.5 |
| VI | diisopropyl ether | 1.5 | 2.0 |
| VII | methyl t-hexyl ether | 0.2 | 1.0 |

It will be apparent to those skilled-in-the-art from inspection of the table that a significantly greater increase in motor octane number (MON) and research octane number (RON) is achieved with phenyl t-butyl ether than with any of the other materials.

In fact the RON improvement is 121% (3.5/2.9) of that attained by the second highest ether; and the MON improvement is 140% (2.8/2.0) of that attained by the second highest ether.

EXAMPLES VIII–XII

In this series of Examples, phenyl t-butyl ether (Ether) is added to a nominal 91 octane, lead-free gasoline and the octane numbers and Blending value determined.

| Example | Ether Vol. % | Octane Numbers RON | MON |
|---|---|---|---|
| VIII* | 0 | 92.4 | 82.2 |
| IX | 2 | 93.5 | 83.2 |
| X | 5 | 94.3 | 83.6 |
| XI | 7 | 94.8 | 84.2 |
| XII | 10 | 95.9 | 85.0 |

| BLENDING VALUES | | |
|---|---|---|
| Example | RON | MON |
| IX | 147.4 | 132.2 |
| X | 130.4 | 110.2 |
| XI | 126.7 | 110.8 |
| XII | 127.4 | 110.2 |

*control

From Examples VIII–XII, it will be apparent that phenyl t-butyl ether is a superior octane appreciator.

Although this invention has been illustrated by reference to specific embodiments, it will be apparent to those skilled-in-the-art that various changes and modifications may be made which clearly fall within the scope of this invention.

We claim:

1. A gasoline composition characterized by improved octane number which comprises a major portion of gasoline and a minor, octane-improving, portion of phenyl t-butyl ether.

2. A gasoline composition as claimed in claim 1 wherein, said octane-improving portion of phenyl t-butyl ether is 1–10 vol% of said gasoline.

3. A gasoline composition as claimed in claim 1 wherein, said octane-improving portion of phenyl t-butyl ether is about 2 vol% of said gasoline.

4. The method of treating a gasoline to improve its octane number which comprises adding, to a major portion of gasoline, a minor, octane-improving, portion of phenyl t-butyl ether.

5. The method of treating a gasoline to improve its octane number which comprises adding to gasoline, phenyl t-butyl ether in amount of 1–10 vol% of said gasoline.

6. The method of treating a gasoline to improve its octane number which comprises adding to gasoline, phenyl t-butyl ether in amount of about 2 vol% of said gasoline.

* * * * *